US005822718A

United States Patent [19]

Bakis et al.

[11] Patent Number: 5,822,718

[45] Date of Patent: Oct. 13, 1998

[54] DEVICE AND METHOD FOR PERFORMING DIAGNOSTICS ON A MICROPHONE

[75] Inventors: Raimo Bakis, Brewster, N.Y.; Francis Fado, Highland Beach, Fla.; Peter John Guasti, Coral Springs, Fla.; Amado Nassiff, Boynton Beach, Fla.

[73] Assignee: International Business Machines Corporation, Armonk, N.Y.

[21] Appl. No.: 790,401

[22] Filed: Jan. 29, 1997

[51] Int. Cl.[6] ..... H04R 29/00

[52] U.S. Cl. ..... 702/180; 381/58; 381/26; 381/111; 364/400.01

[58] Field of Search ..... 364/571.01, 400.01, 364/710.12; 381/58, 59, 60, 150, 26, 111, 95, 122, 168; 704/200, 211, 212; 345/978

[56] References Cited

U.S. PATENT DOCUMENTS

| | | | |
|---|---|---|---|
| 4,346,268 | 8/1982 | Geerling | 179/175.1 A |
| 4,543,537 | 9/1985 | Kuhn et al. | 330/129 |
| 4,817,158 | 3/1989 | Picheny | 381/47 |
| 4,969,193 | 11/1990 | Scott et al. | 381/38 |
| 5,247,458 | 9/1993 | Cabot | 364/550 |
| 5,400,406 | 3/1995 | Heline, Jr. et al. | 381/58 |
| 5,414,755 | 5/1995 | Bahler et al. | 379/67 |
| 5,418,322 | 5/1995 | Minamitaka | 84/609 |
| 5,548,647 | 8/1996 | Naik et al. | 381/42 |
| 5,555,300 | 9/1996 | Gutzmer | 379/395 |
| 5,644,505 | 7/1997 | Soutar et al. | 364/514 R |

OTHER PUBLICATIONS

Lelie, US Statutory Invention Registration H413, "Microphone Output–Level Tester", Jan. 5, 1988.

*Primary Examiner*—John E. Barlow, Jr.
*Assistant Examiner*—Patrick Assouad

[57] ABSTRACT

A device and method are disclosed which perform diagnostics on a microphone and display diagnostic information and instructions to a user. The invention uses a processor to create histograms of the PCM (Pulse Code Modulation) signal after removing any dc bias to determine signal and noise levels and ratios, as well as other parameters. Messages are generated and displayed by the device and method to inform a user that the microphone is working correctly or about possible malfunctions, such as low gain. The messages can advise the user on steps to take to correct the malfunctions, for example, to try a different adapter cable or plug.

21 Claims, 2 Drawing Sheets

DEVICE AND METHOD FOR PERFORMING DIAGNOSTICS ON A MICROPHONE

BACKGROUND OF THE INVENTION

1. Field of the Invention

The present invention relates generally to a device and method for performing diagnostics on an audio interface to a computer, and more particularly to a device and method for performing diagnostics on a microphone connected to a computer.

2. Description of the Prior Art

The use of microphones in connection with personal computers has increased in popularity due to the advent of multimedia environment computing. A microphone is generally connected to a sound card installed within the personal computer. The sound card receives and digitizes the analog signals generated by the microphone. The digitized signals are processed by the PC processor for performing functions such as storage of an audio file in the PC memory or other audio related functions.

A diagnostic or integrity check of the microphone and sound card may determine whether: there exist high noise levels; the level of the digitized signals is within a prescribed range; and the microphone is correctly connected to the sound card. Conventionally, in performing diagnostics on the microphone, test equipment, such as a signal generator, is used which is not portable and also requires one skilled in testing to gather the readings and compute the signal and noise parameters from the readings.

Accordingly, a need exists for a device or method which performs diagnostic or integrity checks on the audio components. The device or method should be PC user-friendly and display diagnostic information and instructions to the user for correcting the parameters. It is desirable to implement a microphone diagnostics device which is able to estimate signal levels and signal-to-noise ratios reasonably accurately, without requiring additional test equipment.

SUMMARY OF THE INVENTION

The invention is generally directed to collection of histograms of PCM signals generated by a microphone to determine signal and noise levels and ratios. Diagnostic messages may be displayed on a display which inform the operator of the operation of the microphone and if any corrective actions are necessary, such as to try a different adapter cable or plug.

Generally, the invention includes a method for performing diagnostics on a microphone connected to a computer comprising the steps of converting analog signals received from the microphone to digital samples; computing a range based on the digital samples; creating a plurality of bins based on the range; associating a counter with each of the plurality of bins; placing the digital samples into one of the plurality of bins; forming a histogram based on values of the counter; and determining percentiles from the histogram. The diagnostic status of the microphone can then be determined based on the percentiles.

A device is also disclosed for performing diagnostics on an audio transducer such as a microphone connected to a computer which converts an analog signal received from the microphone to a digital signal consisting of N samples. The device comprises means for causing a processor to process each of the N samples to provide a set of histogram counts to determine PCM percentile values for the N samples, and compute parameters of the digital signal using the PCM percentile values.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENTS

Figure 1:
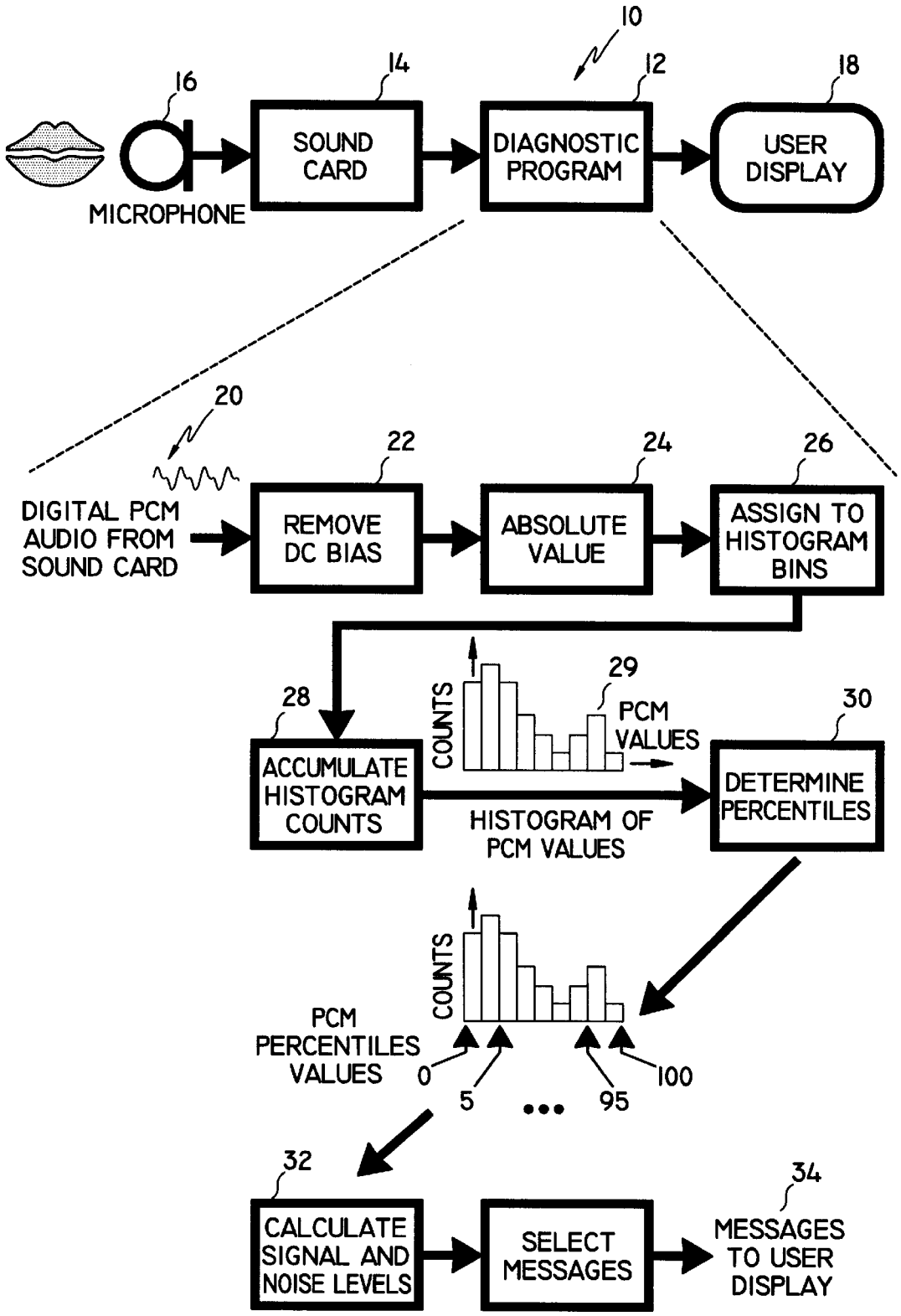
FIG. 1 is a schematic illustration of the system and method for performing diagnostics on a microphone in accordance with the present invention.

A device for performing diagnostics on a microphone in accordance with the present invention is shown by FIG. 1 and designated generally as 10. The microphone diagnostics device 10 includes a diagnostic card or program (hereinafter "program") 12 which is connected to a A/D convertor such as a sound card 14. The sound card 14 is connected to a microphone 16 which receives utterances from a speaker. A user display 18 is also connected to the program 12 for displaying messages regarding the operation of the device 10 and the values of various signal and noise parameters, such as signal levels and signal-to-noise ratios. The messages can instruct a user on how to correct or adjust the parameters. For example, which buttons and/or levers on a sound mixer to depress or adjust for obtaining the "proper" signal and noise parameters. The microphone diagnostics device 10 will now be discussed in detail with reference to FIGS. 1 and 2.

When the user speaks into the microphone 16, the resulting electrical analog signal goes to the sound card 14. The sound card 14 is typically in a computer or a sound mixer. The sound card 14 converts the signal to a digital form, typically a PCM (Pulse Code Modulation) representation 20. This form consists of a series of binary-coded numbers, each representing the sampled value of the electrical analog signal at a specific time point. The sampling rate is typically the industry standard 44100 samples per second, or some sub-multiple of this, such as 11025 samples per second.

The digital PCM signal 20 is analyzed by the program 12 of this invention, labelled "Diagnostic Program" in FIG. 1. That program 12 generates messages for the user, and displays them on the user display 18. The messages either tell the user that the microphone 16 works correctly, or they give information and instructions about possible malfunctions, such as low gain, no signal, etc. The messages may advise the user, for example, to try a different adapter cable or plug.

The functions of the program 12 are shown by FIG. 1. The first operation is the removal of any dc (direct-current) bias 22. Let $x_i$ be the PCM signal value at the i-th sample. Assume that the entire signal consists of N samples. The dc bias is then defined as $$b = 1/N \sum_{i=1}^{N} x_i. \tag{1}$$

The next step is to take the absolute value of the bias-corrected samples, $x_i$-b, 24. These absolute values are then assigned to histogram bins, e.g., stored within a memory, 26. Let $y_i$ be the absolute value of the i-th bias-corrected sample, so that:

$$y_i = |x_i - b|. \tag{2}$$

To determine the sizes of the bins, the program 12 first finds the largest and smallest sample values of y, call them $y_{max}$ and $y_{min}$. It then divides this range into some number M of equal bins. In the preferred embodiment, M=1000. The width of each bin is then $$w = \frac{y_{max} - y_{min}}{M} + \epsilon. \quad (3)$$

The increment $\epsilon$ is added to the width of the bin to ensure that the total range covered by all the bins is sufficient in spite of possible rounding errors. In the preferred embodiment, all computations are done with integers, and $\epsilon$=1 is used. The lower boundary of the j-th bin is then $$l_j = y_{min} + (j-1)w \quad (4)$$

and the upper boundary is $$u_j = y_{min} + jw. \quad (5)$$

For each sample, $y_i$, the corresponding bin number, $j_i$, is then computed:

$$j_i = 1 + \frac{y_i - y_{min}}{w}. \quad (6)$$

In the above equation, the result of the computation is rounded down to the nearest integer. Thus, $j_i$ always has an integer value.

The program 12 associates a counter with each bin. The program 12 then processes all samples starting with $i_1$ and ending with $i_2$, incrementing the $j_i$-th counter by one for each sample to accumulate histogram counts 28. In the preferred embodiment, the first sample to be processed, $i_1$, is 0.25 seconds from the start of the signal, to ensure that any switching transients or noises have decayed. Similarly, the last sample, $i_2$, is a quarter of a second before the end of the signal to avoid any noises such as key clicks when the user switches the microphone 16 off.

The resulting set of counts is called the histogram, and is represented schematically in FIG. 1 as a bar chart 29. From the histogram 28, the program 12 determines percentiles 30 as follows. For each bin, the program 12 calculates the cumulative count $c_j$ by using the formula:

$$c_j = c_{j-1} + n_j \quad (7)$$

where $n_j$ is the count in the j-th bin. Also, $$c_1 = n_1. \quad (8)$$

To determine the PCM value corresponding to the p-th percentile, the program 12 first calculates the number of sample values that are below that percentile:

$$L(p) = \frac{pc_M}{100}. \quad (9)$$

Note that $c_M$ is the cumulative count in the last bin, hence it is the total number of samples represented by the histogram. This number may be smaller than the total number of samples in the signal, N, because some samples from the beginning and end of the signal were omitted to avoid noise transients. Thus, for example, if the entire histogram represents 10,000 samples, then the 25-th percentile is a PCM value such that 2,500 samples are below it, according to equation (9): L(p)=(25×10000)/100=2500.

The program 12 then looks for a bin such that its cumulative count is exactly L(p), or 2500 in the example. If it finds such a bin, say the j-th one, then the upper boundary of that bin, $u_j$, as given by equation (5), is the required PCM percentile value, which will be represented by y(p); y(p) is a value such that p percent of the samples $y_i$ have values less than y(p). If the program 12 does not find such an exact match, it looks for a bin such that the lower bound is below L(p) and the upper bound is above L(p), and estimates the PCM value by linear interpolation.

The program 12 uses such PCM percentile values to estimate signal and noise levels and signal-to-noise ratios 32. If the recorded signal contains no speech, only pure noise, then it is well known that the histogram of the PCM values tends to resemble that of a Gaussian distribution. For a Gaussian distribution with a standard deviation of $\sigma$, approximately 10% of the samples have an absolute value less than $\sigma/8$, as those skilled in the art can easily determine by means well-known, such as tables or computational tools. Thus, by multiplying the 10-th percentile PCM value by eight, the standard deviation of the noise can be estimated, which is also its root-mean-square (rms) amplitude.

Similarly, for a Gaussian distribution, approximately 95.45% of the samples have an absolute value less than $2\sigma$. Rounding to the nearest integer, the program looks at the 95-th percentile PCM value, and divides this by two to get another estimate of the rms amplitude. If these two estimated rms values are approximately equal, then the recorded signal is likely to contain only pure noise, no speech.

Consider, on the other hand, a recording which contains periods of speech and periods of silence. Let $\sigma$ again represent the rms amplitude of the noise, and assume that the speech signal is considerably stronger than the noise. Assume also that some fraction f of the total time is occupied by speech, and the rest, or 1−f of the time, is silence, where 0<f<1. The silence samples contain pure noise, and approximately 10% (a fraction of 0.1) of those have absolute values less than $\sigma/8$. Then the total fraction of samples that represent pure noise and where furthermore the sample value is below $\sigma/8$ would be approximately 0.1(1−f). It is reasonable to assume that this threshold of $\sigma/8$ is so low that only a negligible number of speech samples would have absolute values below it. Thus by finding a PCM value such that a fraction of 0.1(1−f), or (1−f)×10% are below it, the PCM value that is one-eighth of the rms noise amplitude will have been found.

It is also assumed that the speech signal is strong enough that no significant number of silence samples have amplitudes greater than the 95-th percentile of the speech signal. Thus only 5% of the speech samples would have values greater than this 95-th percentile level. Because speech occupies only a fraction f of the total time, then f×5% of the total samples are above this level, or 100%−(f×5%) of the samples are below this level. Thus by setting p=100%−(f×5%) and finding the corresponding PCM level y(p), an estimate of the speech signal level is obtained. Although the amplitude distribution of speech is not Gaussian, an approximate speech rms level can still be calculated by dividing this 95-th percentile level by two, as if it were Gaussian. The difference between this estimated speech rms level and the estimated noise level determined as described in the previous paragraph, gives an estimate of the signal to noise ratio.

A second estimate of the noise level can be obtained by asking the user to record a signal with no speech, but with the microphone 16 open. Again, percentile levels can be used to estimate the rms background noise level as discussed above. Thus, there are two estimates of the background noise, one from the separate silence recording, and one from the silence periods of the speech signal. Both of these can be compared to the speech signal level, and if either of them comes too close to the speech level, a diagnostic message 34 can be issued to the user via the user display 18.

The program 12 must also determine whether the signal level is too high, so that the sound card. 14 is being overloaded. Because the digital PCM signal 20 will never exceed the sound card's clipping level, no matter how large the analog input signal, then at first glance it would seem that the program 12 cannot determine whether there is overloading or how much excessive signal there is. However, it has been observed that in normal speech, the ratio between the 100-th percentile PCM level (absolute peak value) and the 95-th percentile level is typically in the range of three to five.

In the case of overloading, the peak value would be unable to increase beyond the clipping level, but the 95-th percentile could continue increasing as long as it is below the clipping level. Consequently, the ratio between the 100-th and the 95-th percentile levels would decrease, ultimately approaching one if the overloading was sufficiently severe. This ratio, therefore, can be used as an indicator of excessive signal levels to signify the need for corrective action, even if the signal-to-noise ratio is satisfactory. If the ratio is not sufficiently above one, a message is issued to the user, saying that the signal level is too high, and possibly suggesting remedies. Or, if the gain is under program control, the program 12 can attempt to reduce the gain automatically, and request another speech recording to verify that the operation is now satisfactory.

Figure 2:
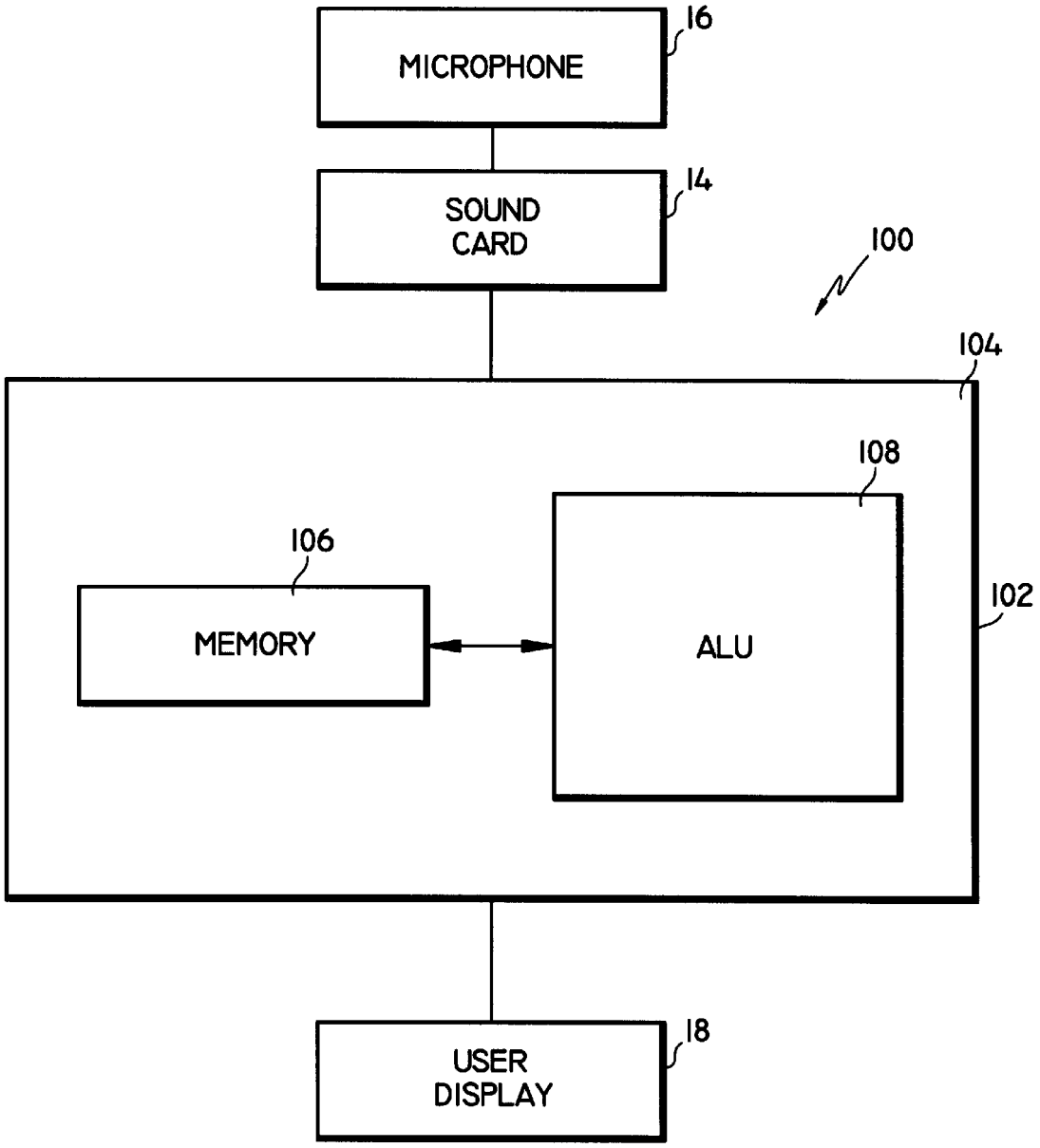
FIG. 2 is a block diagram of an illustrative system in accordance with the present invention.

FIG. 2 illustrates another embodiment of the present invention. The microphone 16 transmits the analog signal to the sound card 14. The sound card 14 converts the analog signal to a digital signal, which is forwarded to diagnostic device 100, which includes a processor 102 having a central processing unit (CPU) 104, a memory 106, and an arithmetic logic unit (ALU) 108. The CPU 104 receives the digital signal and removes any dc bias by any known filtering process to provide the bias-corrected samples. The ALU 108 takes the absolute value of the bias-corrected samples and stores the data in the memory 106. The absolute value of the bias-corrected samples can be retrieved from the memory 106 for further processing to provide the histogram 28. The signal and noise parameters are determined by the ALU 108 by analyzing the percentiles determined from the histogram 28. Finally, the device 100 transmits diagnostic information and instructions based on the determined percentiles which are displayed on user display 18.

The appendix attached hereto includes source code for implementing a method for performing diagnostics on a microphone according to the present disclosure.

Many changes and modifications in the above-described embodiments of the invention can of course, be carried out without departing from the scope thereof. For example, in the second embodiment, functions of device 100 may be implemented by hardware components. CPU 104, memory 106 and ALU 108 may be corresponding components of an IBM based PC or any equivalent PC. Accordingly, that scope is intended to be limited only by the scope of the appended claims.

What is claimed is:

1. A method for performing diagnostics on a microphone connected to a computer, comprising the steps of:

converting analog signals received from the microphone to digital samples;

computing a range based on said digital samples;

creating a plurality of bins based on said range;

associating a counter with each of said plurality of bins;

placing said digital samples into one of said plurality of bins;

forming a histogram based on values of said counter in a predetermined time after the microphone is turned on;

determining percentiles from said histogram; and determining diagnostic status of said microphone based on said percentiles.

2. The method as defined by claim 1, further comprising the steps of:

filtering the dc bias from said samples; and computing absolute values of said samples before said range is computed.

3. The method as defined by claim 2, wherein the dc bias, b, is determined by $$b = 1/N \sum_{i=1}^{N} x_i,$$

where $x_i$ is a PCM signal value of an i-th digital sample.

4. The method as defined by claim 2, wherein a range of absolute values, w, that can be stored in each of said plurality of bins is determined by $$w = \frac{y_{max} - y_{min}}{M} + \epsilon,$$

where $y_{min}$ and $y_{max}$ are the smallest and largest bias-corrected sample values, respectively, M is an arbitrary integer, and $\epsilon$ is an incremental value.

5. The method as defined by claim 4, wherein M is about 1000 and $\epsilon$ is one.

6. The method as defined by claim 4, wherein a lower boundary, $l_j$, of each of said plurality of bins, j, is determined by $$l_j = y_{min} + (j-1)w$$

and wherein an upper boundary, $u_j$, of each of said plurality of bins, j, is determined by $$u_j = y_{min} + jw.$$

7. The method as defined by claim 4, wherein a bin, $j_i$, storing a particular bias-corrected sample, $y_i$, is determined by $$j_i = 1 + \frac{y_i - y_{min}}{w},$$

where $j_i$ is rounded down to the nearest integer to have an integer value.

8. The method as defined by claim 1, wherein the step of determining percentiles from said histogram, comprises the steps of:

determining an individual PCM value, y(p), corresponding to a particular percentile, p, by calculating the number of samples below the particular percentile, p, using the equation:

$$L(p) = \frac{pc_M}{100},$$

where $c_M$ is the total number of samples represented by the histogram;

determining a bin having a cumulative count, $c_j$, equal to L(p), where an upper boundary, $u_j$, of said bin is equal to the PCM value, y(p), corresponding to the particular percentile, p; and determining a bin having a lower boundary below L(p) and an upper boundary above L(p) and estimating the PCM value, y(p), if said bin having the cumulative count, $C_j$, equal to L(p) cannot be determined.

9. The method as defined by claim 8, wherein the cumulative count, $c_j$, is determined by $$c_j = c_{j-1} + n_j.$$

where $n_j$ is a cumulative count in a j-th bin.

10. The method as defined by claim 1, wherein a fraction f of said samples represent speech and a fraction 1-f of said samples represent silence, where approximately 10% of said samples representing silence have absolute values less than $\sigma/8$, where $\sigma$ represents the root-mean square noise amplitude of said samples representing silence.

11. The method as defined by claim 10, wherein a percentile that is one-eighth of the rms noise amplitude is equal to a percentile having 0.1(1-f) of said samples representing silence below it.

12. The method as defined by claim 10, wherein an estimate of a corresponding signal level of said samples representing speech is determined by computing 100%−(f×5%) and finding a corresponding PCM value, y(p).

13. The method as defined by claim 8, wherein overloading of said computer by a high signal level is determined if a ratio between a 100-th and a 95-th percentile approaches one.

14. A device for performing diagnostics on an audio transducer connected to a computer which converts an analog signal received from the transducer to a digital signal having N samples, comprising:

means for causing a processor to process each of the N samples to provide a set of histogram counts in a predetermined time after the audio transducer is turned on;

means for determining PCM percentile values for the N samples; and means for computing parameters of the digital signal using the PCM percentile values.

15. The device as defined by claim 14, further comprising means for causing display of one or more messages based on the computed parameters.

16. The device as defined by claim 14, wherein said means for causing processor further having means for causing processing each of the N samples by computing absolute values of the N samples and processing each of the absolute values to provide the set of histogram counts by computing a range based on said absolute values, creating a plurality of bins based on said range, associating a counter with each of said plurality of bins, placing the N samples into one of said plurality of bins based on corresponding absolute values, and forming a histogram based on values of said counter.

17. The device as defined by claim 16, wherein the processor determines PCM percentile values for the N samples by:

determining an individual PCM value, y(p), corresponding to a particular percentile, p, by calculating the number of samples below the particular percentile, p, using the equation:

$$L(p) = \frac{pc_M}{100},$$

where $c_M$ is the total number of samples represented by the histogram;

determining a bin having a cumulative count, $c_j$, equal to L(p), where an upper boundary, $u_j$, of said bin is equal to the PCM value, y(p), corresponding to the particular percentile, p; and determining a bin having a lower boundary below L(p) and an upper boundary above L(p) and estimating the PCM value, y(p), if said bin having the cumulative count, $c_j$, equal to L(p) cannot be determined.

18. The device as defined by claim 16, further comprising:

means for causing said processor to perform at least one corrective action on said transducer based on said computed parameters.

19. A method for performing diagnostics on a microphone connected to a computer, comprising the steps of:

converting analog signals received from the microphone to digital samples having a range of values;

forming a histogram based on values of said digital samples in a predetermined time after the microphone is turned on;

determining percentiles from said histogram; and determining diagnostic status of said microphone based on said percentiles.

20. A method for performing diagnostics on a microphone connected to a computer, comprising the steps of:

converting analog signals received from the microphone to digital samples;

computing a range based on said digital samples;

creating a plurality of bins based on said range;

associating a counter with each of said plurality of bins;

placing said digital samples into one of said plurality of bins;

forming a histogram based on values of said counter;

determining percentiles from said histogram;

determining diagnostic status of said microphone based on said percentiles;

filtering the dc bias from said samples; and computing absolute values of said samples before said range is computed.

21. A device for performing diagnostics on an audio transducer connected to a computer which converts an analog signal received from the transducer to a digital signal having N samples, comprising:

means for causing a processor to process each of the N samples to provide a set of histogram counts, said means for causing processor further having means for causing processing each of the N samples by computing absolute values of the N samples and processing each of the absolute values to provide the set of histogram counts by computing a range based on said absolute values, creating a plurality of bins based on said range, associating a counter with each of said plurality of bins, placing the N samples into one of said plurality of bins based on corresponding absolute values, and forming a histogram based on values of said counter;

means for determining PCM percentile values for the N samples; and means for computing parameters of the digital signal using the PCM percentile values.

* * * * *